United States Patent [19]

Cardas

[11] Patent Number: 4,980,517

[45] Date of Patent: Dec. 25, 1990

[54] MULTI-STRAND ELECTRICAL CABLE

[75] Inventor: George F. Cardas, Ontario, Calif.

[73] Assignee: TP Orthodontics, Inc., Westville, Ind.

[21] Appl. No.: 411,677

[22] Filed: Sep. 25, 1989

[51] Int. Cl.[5] ..... H01B 5/08; H01B 5/10

[52] U.S. Cl. ..... 174/127 R; 57/213; 57/216; 174/130; 174/131 A

[58] Field of Search ..... 174/42, 114 R, 119 R, 174/127, 128.1, 129 R, 130, 131 R, 131 A, 131 B; 57/212, 213, 214, 216, 217, 218, 220, 221, 222, 223

[56] References Cited

U.S. PATENT DOCUMENTS

| | | | |
|---|---|---|---|
| 3,015,205 | 1/1962 | Massot et al. | 52/517 |
| 3,413,799 | 12/1968 | Lejeune | 174/113 R X |
| 4,538,023 | 8/1985 | Brisson | 174/113 R X |
| 4,628,151 | 12/1986 | Cardas | 174/114 R |

FOREIGN PATENT DOCUMENTS

| | | | |
|---|---|---|---|
| 989718 | 5/1951 | France | 174/131 B |
| 653719 | 5/1951 | United Kingdom | 174/131 B |
| 2080845 | 2/1982 | United Kingdom | 57/213 |

*Primary Examiner*—Laramie E. Askin
*Attorney, Agent, or Firm*—Lloyd L. Zickert

[57] ABSTRACT

A multi-strand electrical cable having electrically conductive strands of different cross-sections, i.e. cross-sectional areas, arranged in ascending order of strand cross-section from the center toward the outer circumference of the cable and sized in accordance with an irrational and preferably golden ratio progression in such a way that larger strands are located outwardly toward the cable circumference relative to smaller strans and stabilize the smaller strands against resonant vibration in a manner such as to reduce cable resonance produced by fluctuating current flow through the cable.

3 Claims, 2 Drawing Sheets

MULTI-STRAND ELECTRICAL CABLE

BACKGROUND OF THE INVENTION

1. FIELD OF THE INVENTION:

This invention relates generally to electrical cables of the kind having a multiplicity of electrically conductive strands for conducting electrical energy through the cable. The invention relates more particularly to an improved multi-strand electrical cable which is uniquely constructed and arranged to suppress cable resonance and enhance the electrical power and signal transmission characteristics of the cable.

2. DISCUSSION OF THE PRIOR ART:

It has long been recognized that efficient electrical power and signal transmission applications requires the use of multi-conductor electrical cables; that is, electrical cables having a multiplicity of individual electrical conductors or wire strands. In some multi-strand cables, all of the strands are of the same cross-sectional size. Other multi-strand cables have strands of differing cross-sectional sizes. The cable strands are commonly twisted about the longitudinal centerline of the cable and encased within an insulating sheath which confines the body of strands radially of the cable. For reasons which are well understood in the electrical art and need not be explained in this disclosure, such multi-strand cables are characterized by enhanced electrical and mechanical properties relative to a single conductor cable. Among the foremost of these enhanced properties are improved fidelity and phase coherence in the case of audio and data signal transmission cables, and reduced electrical power losses and increased cable strength-to-weight ratio in the case of electrical power transmission cables or lines.

Further improvement in electrical power transmission lines was achieved a few years ago by replacing the copper conductors of multi-strand transmission cables with aluminum conductors. While aluminum has a lower electrical conductivity than copper, its density is sufficiently less than copper as to more than offset its lower conductivity and yield a conductivity-to-weight ratio greater than copper.

The present invention addresses one problem which is encountered to varying degrees in virtually all multi-strand electrical cables. This is the problem of reducing or eliminating resonance in the cables; that is, resonant vibration of the cable strands, which tends to occur in all multi-strand electrical cables, especially electrical power transmission lines. While this resonance problem is most pronounced in electrical power transmission lines, it may also occur, though to a much lesser extent, in audio and data signal transmission cables. In all cables in which it does occur, resonance has certain undesirable consequences which are discussed later. For this reason reduction or elimination of such cable resonance is highly desirable.

The phenomenon of electrical resonance in a multi-strand electrical cable is well known and understood by those versed in the electrical cable art and thus need be explained in this disclosure only in sufficient detail to enable a full and complete understanding of the invention. Suffice it to say that electrical current flow through a multi-strand cable produces like charges in and corresponding repulsion forces between the individual cable strands at every position along the strands. The current flow through cable strands of differing cross-sections,i.e. cross-sectional areas, and hence the electrical charges produced in the strands by such current flow, are directly proportional to the cross-sections of the strands. The effective repulsion force acting between adjacent strands of differing cross-sections is equal to or proportional to the charge in the smaller strand. This effective repulsion force urges the strands laterally apart against the action of an essentially resilient resisting force created by the elastic properties of and tension in individual strands, the mutual support between the strands, and the radial constraint of the cable sheath.

Fluctuations in the current flow through the cable strands produces corresponding fluctuations in the strand charges and thereby in the repulsion forces between adjacent strands. These fluctuations in the repulsion forces interact, in effect, with the resilient resisting forces on the strands in a manner which tends to cause relative back and forth lateral motion, that is, vibration, of the strands. The resulting relative vibratory movements or displacements of the cable strands vary their reactances and thereby introduce additional fluctuations and frequency components into the current flow through the cable.

In the case of multi-strand cables for A.C. electrical power transmission and signal transmission, current flow through the cables inherently fluctuates and thus tends to cause at least some degree of vibration of the cable strands in the manner discussed above. Cable strand vibration often occurs in multi-strand D.C. electrical power transmission cables also, however. This is due to the fact that any momentary spike or other momentary fluctuation in the D.C. current flow through the cable tends to cause relative displacement of the cable strands and produce a resultant change in the reactance of the strands. This change in reactance tends to counteract the original current fluctuation and thereby restore the cable strands to their original relation or positions. During this return of the strands to their original positions, the cable strands again undergo relative displacement which changes their reactance and introduces further fluctuations into the current flow through the strands. The end result of this action is vibration of the cable strands in much the same way as in an A.C. power cable.

If a strong frequency component or frequency components of the current flow through a multi-strand electrical cable approximate the natural frequency or frequencies of some or all of the cable strands, these strands tend to commence resonant vibration. This condition of resonant vibration of the cable strands is referred to in the art and in this disclosure as cable resonance. In an electrical power transmission line, this cable resonance produces an audible "hum" and has several undesirable effects. Foremost among these are the following. Resonance causes rubbing of the cable strands against one another which produces frictional heating and consumes electrical energy, thereby increasing the overall transmission line losses. Resonant vibration of the cable strands produces frictional wear and fatigue stress in the cable strands which weakens the strands and thereby the entire cable.

At the present time, such resonance in electrical power transmission cables is reduced somewhat by resonance dampers placed on the lines at intervals of about every two miles or so. While these dampers are effective to some extent, their damping effect is most pronounced in the immediate vicinity of the dampers and diminishes greatly or completely disappears in the regions between the dampers. Moreover, the dampers are relatively costly to procure, install, and maintain.

Although cable resonance is most pronounced and produces the most destructive effects in electrical power transmission lines, such resonance may also occur with undesirable consequences in electrical signal transmission cables, such as audio and data signal transmission cables. In these latter cable applications, while resonance may not produce physical destruction of the cable strands, such resonance can seriously degrade the transmitted signals by creating noise, distortions, and other aberrations in the signals.

A number of multi-strand signal transmission cable designs with various conductive strand arrangements have been devised for enhancing certain cable characteristics. Among the prior patents in this area, for example, are Brisson #4,538,023 and Cardas #4,628,151. Brisson discloses a multi-strand audio signal transmission cable of the kind commonly referred to as a Litz cable wherein relatively smaller diameter strands are disposed radially outwardly of relatively larger diameter strands, and are arranged to enhance the signal carrying capability of the cable. Cardas discloses a multi-strand cable wherein the cable strands have differing sizes and are relatively sized in accordance with the so-called "golden ratio progression" to further enhance the signal and power carrying capability of the cable. According to this golden ratio progression, the ratio of each strand cross-section to the cross-section of the next larger strand equals the ratio of the larger strand cross-section to the sum of the two strand cross-sections. Another patent of some interest in connection with multi-strand cables is Lejeune #3,413,799, disclosing a multi-strand reinforcing cable for automobile tires having strands of differing diameters.

None of the above-mentioned prior art patents or any other patents of which I am aware addresses the problem of reducing or eliminating resonance in a multi-strand electrical cable. While transmission line dampers have been devised to alleviate transmission line resonance, they are not totally satisfactory for the reasons stated earlier. Accordingly, there is a definite need for an improved multi-strand electrical cable which alleviates or eliminates such resonance. This invention provides such an improved multi-strand electrical cable.

SUMMARY OF THE INVENTION

The basic purpose of this invention is to reduce or substantially eliminate resonance in a multi-strand electrical cable having conductive wire strands of differing sizes (i.e.cross-sections)and thereby avoid the above-noted and other adverse consequences of such resonance. According to one important aspect of the invention, this purpose is accomplished by arranging the strands in such a way that the strand sizes increase toward the outer circumference of the cable. Larger cable strands are thus located radially outward of the cable relative to smaller strands. This cable strand arrangement causes the vibrational motions or displacements of smaller strands produced by fluctuations in the cable current flow to be vectored inwardly toward the center of the cable in such a way that resonant vibration of smaller strands at any side of the cable is suppressed by larger strands at the same side of the cable and by diametrically opposite strands. In other words, the cable strands are arranged in such a way that larger strands stabilize smaller strands against resonant vibration.

According to another important aspect of the invention, the cable strands are relatively sized to (a) reduce the number of resonant multiples in the cable; that is, pairs or groups of strands which have the same or harmonically related natural frequencies and are associated by mutual contact, proximity or other vibrational coupling mode in such a way that resonant vibration of any strand promotes and reinforces resonant vibration of the other associated strand(s), (b)provide damping multiples in the cable; that is, associated strands whose natural frequencies/periods are irrationally related such that vibration of any strand will suppress resonant vibration of the other associated strand(s), and (c) supress rotational resonance in a cable of the invention having twisted strands.

Several preferred embodiments of the improved multi-strand cable of the invention are disclosed. Certain of these preferred embodiments have cable strands of differing cross-sections which are sized to conform as closely as possible to the golden ratio progression in order to minimize the number of resonant multiples and maximize the number of damping multiples in the cables. In all of the disclosed embodiments, the cable strands are arranged in such a way that larger strands are located radially outward of smaller strands to stabilize the smaller strands against resonant vibration.

DESCRIPTION OF THE PREFERRED EMBODIMENTS

Figure 1:
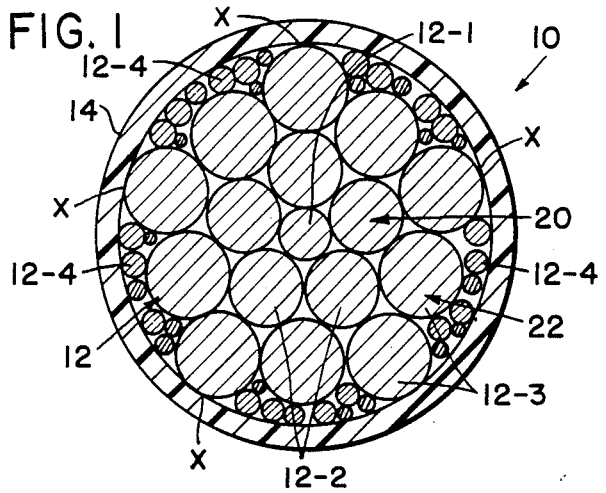
FIG. 1 is a transverse cross-section through an improved multi-strand electrical cable according to the invention.

Turning now to these drawings and first to FIG. 1 thereof, there is illustrated an improved multistrand electrical cable 10 according to the invention. Cable 10 has a multiplicity of electrically conductive wire strands 12 of differing sizes, i.e.cross-sections, and an outer insulating sheath 14. The outer sheath 14 surrounds the strands 12 and firmly confines them in their illustrated layup arrangement. According to one aspect of the invention, the strands 12 are arranged with the smaller strands toward the center of the cable and the larger strands toward the outer circumference of the cable, as explained below and shown in FIG. 1. Between the outermost large strands 12-3 and the sheath 14 are smaller fill-in strands which effectively fill in or cover the relatively large recesses between the outer large strands 12-3 to provide the mass of strands and thereby the cable as a whole with a relatively smooth circumference.

Figure 1A:
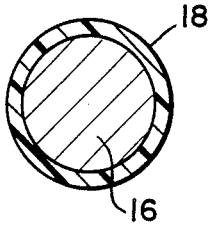
FIG. 1*a* is a transverse cross-section through an insulated wire strand which may be used in the present cable.
Figure 1B:
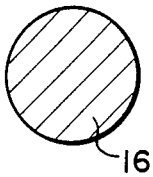
FIG. 1*b* is a transverse cross-section through an uninsulated wire strand which may, be used in the present cable.

Each cable strand 12 comprises an electrical conductor 16. Depending upon the intended use of the cable, the cable strands 12 may be an insulated wire as shown in FIG. 1*a*, wherein an insulating sheath 18 surrounds the conductor 16, or an uninsulated wire wherein the bare conductor 16 forms the strand as shown in FIG. 1*b*. Also, the conductor may be formed form copper or aluminum. Thus, some cable applications require the insulated cable strands of FIG. 1*a*, whereas other cable applications permit or require the use of the bare strands of FIG. 1*b*. Electrical power transmission lines, for example, may be formed from aluminum and may require the insulated strands of FIG. 1*a* for corona control and corrosion protection. Electrical signal transmission cables, such as audio and data transmission cables, on the other hand, generally comprise copper conductors and may use or require the bare wire strands of FIG. 1*b*.

It is important to note here that that for convenience of illustration, FIGS. 1–6 of the drawings illustrate the cable strands 12 as simple circles. It will be understood that these strands may be either the insulated strands of FIG. 1*a* or the bare wire strands of FIG. 1*b*. Further, reference is made in this disclosure to the strand "cross-sections". Unless otherwise noted, this term refers to cross-section of the strand conductor 16 only.

As mentioned earlier, it is well known in the art that the use of multiple conductive strands in an electrical cable enhances certain electrical and mechanical properties of the cable compared to a cable with a single conductor having a cross-section equivalent to the combined cross-sections of the conductors of the several strands in a multi-strand cable. It is also known that the use of cable strands of different sizes, that is, cross-sections, in multistrand electrical signal transmission cables, such as audio and data signal transmission cables, further enchances certain transmission properties of the cables, such as signal-to-noise ratio and phase coherence, particularly if the cable strands are sized in accordance with the golden section ratio or golden ratio progression referred to earlier. In this latter regard see the earlier mentioned Cardas patent #4,628,151.

As explained in this Cardas patent, cable strands sized in accordance with this golden ratio progression have cross-sections which differ in such a way that the ratio of the cross-section of any strand to the cross-section of the next larger strand equals the ratio of the cross-section of the larger strand to the sum of the cross-sections of the two strands. This "golden ratio" is about 0.62. A typical golden ratio progression is 1, 1, 2, 3, 5, 8, 13, 21, 34, 55, 89, 144, 233, 377, 610, 987, 1597.

While multi-stand electrical cables of the character described possess many desirable properties, they suffer from one problem which this invention addresses. This is the problem of resonance referred to earlier. The resonance phenomenon which occurs in electrical cables, particularly high voltage electrical power transmission cables, is well understood and hence need be discussed in this disclosure only in sufficient detail to enable a full and complete understanding of the invention. Suffice it to say that current flow through an electrical cable produces like electrical charges in all of the cable strands at every position along the strands. These like charges create repulsion forces between the strands tending to urge the strands apart. The repulsion forces are opposed by a somewhat elastic resisting force produced by the resiliency of the strands and by the confining action of the surrounding cable sheath.

Any fluctuations in the current flow through the cable produce corresponding changes in the electrical charges in the cable strands and thereby also in the repulsion forces between the strands. These fluctuations in the repulsion forces, in turn, tend to effect lateral motion or deflection of the cable strands in one direction or the other depending upon whether the repulsion forces increase or decrease. In other words, increasing repulsion forces resulting from increasing current fluctuations tend to spread the cable strands radially of the cable against the elastic resisting forces created by the strands and the cable sheath. Decreasing repulsion forces resulting from decreasing current fluctuations tend to effect radial contraction of the strands by the elastic resisting forces. In other words, fluctuations in current flow through the cable tend to cause lateral vibration of the cable strands. Relative displacement of the cable strands during such vibrations of the strands varies the reactances of the strands and thereby introduces additional fluctuations and frequency components into the current flow through the cable. These additional current fluctuations promote additional vibratory motion of the strands which in turn cause additional reactance changes in the strands and thereby additional current fluctuations, and so on.

Consider now two associated cable strands of different cross-sections during current flow through the cable. The current flows through and hence also the charges in the strands are proportional to the strand cross-sections. The repulsion force acting between the strands as a result of these current flows through the strands is proportional to the charge in the smaller strand. An increase in the repulsion force produced by an increase in current flow tends to separate the strands in such a way that the motion or displacement of each strand is proportional to its charge-to-mass ratio. This is the ratio of the charge in the smaller strand (which determines the repulsion force acting between the strands) to the mass of the respective strand. Thus, a given increase in current flow tends to cause greater separation motion or displacement of the smaller strand than the larger strand. Stated more simply, the larger strand tends to remain relatively stationary and the smaller strand tends to move away from the larger strand.

The current flow through A.C. power transmission cables and signal transmission cables, such as audio and data signal transmission cables, is inherently a fluctuating current flow which tends to produce vibration of the cable strands in the manner discussed above. However, the conductive strands of D.C. power transmission cables may also be subject to at least periodic vibration owing to spikes in the D.C. current flow which tend to cause relative motion or displacement of the cable strands and the changes in the strand reactances caused by such relative strand motion which introduce additional fluctuations into the current flow. These additional current fluctuations produce additional vibratory motion of the strands, resulting in more reactance changes in the strands and more current fluctuations, and so on. The end result of this action is vibration of the cable strands.

Each cable strand has a natural frequency of vibration determined by the longitudinal tension in the strand and the mass and hence cross-section of the strand. If the current flow through a multi-strand cable contains a strong frequency component or components which match(es) or approximate(s) the natural frequency or frequencies of a strand or group of strands in the cable or a harmonic of such frequency or frequencies, such strands will tend to resonate, that is, vibrate at their natural frequencies. Moreover, if a pair or group of such strands are associated by mutual contact, positional proximity, or some other mode of vibrational energy coupling, resonance of each strand tends to initiate or reinforce resonance of the associated strand(s). In this disclosure, this resonant vibration of the cable strands is referred to as cable resonance. The expression "resonant multiple" is used to mean a pair or group of cable strands having substantially the same natural frequency or harmonically related natural frequencies and which are associated by mutual contact, positional proximity, or some other mode of vibrational energy transfer such that resonant vibration of any strand will tend to initiate or reinforce resonant vibration of the other associated strand(s). The expression "damping multiple" is used to mean the antithesis of a resonant multiple; that is, a pair or group of cable strands which are associated by mutual contact, positional proximity, or some other mode of vibrational energy coupling and have irrationally or non-harmonically related natural frequencies or periods of vibration such that vibration of any strand will tend to suppress rather than reinforce resonant vibration of the other associated strand(s).

The conductive strands in multi-strand cable are commonly twisted about the longitudinal axis of the cable. In this case, a component of the cable resonance discussed above is directed circumferentially of the cable and is referred to as rotational resonance. This rotational resonance generates resonant reflections between the radially outermost points or regions of the cable, such as between regions X in FIG. 1 where impedance mismatches exist.

The existing multi-strand electrical cables are not designed to suppress such cable resonance. As noted earlier, such cable resonance is most pronounced in high voltage electrical power transmission lines and produces the familiar "hum" which may heard in the vicinity of such lines. Cable resonance produces many undesirable consequences, among the most serious of which are frictional heat generation due to rubbing of the cable strands against one another resulting in electrical power loss, cable wear and fatigue effects, and transmitted signal degradation in the form of increase signal noise, signal distortion, and reduced signal phase coherence. Resonance in power transmission lines is reduced to some extent by resonance dampers which are mounted on the lines at intervals therealong. As noted earlier, however, these dampers are not very satisfactory.

A primary purpose of this invention is to reduce or eliminate such cable resonance and thereby also the above and other adverse consequences of such resonance. According to one important aspect of the invention, this purpose is accomplished by arranging the conductive strands 12 of the cable 10 in FIG. 1 so that the cable sizes increase progressively from the center toward the outer circumference of the cable. Larger cable strands are thus located outwardly of smaller stands in such a way that resonant vibration of the strands is suppressed. Thus, recalling the earlier discussion regarding the current-fluctuation-induced motions of differently sized associated strands in accordance with their charge/mass ratios, it will be understood that in the strand arrangement of FIG. 1, varying repulsion forces between the strands produced by fluctuations in the current flow through the strands tend to cause the inner smaller strands to move relative to outer larger strands which remain relatively stationary. Accordingly, vibrational motions of the smaller strands produced by increasing current fluctuations are vectored, as it were, inwardly toward the center of the cable; that is, they occur away from the outer larger strands and inwardly toward the center of the cable. These inward strand motions are resisted, in turn, by the diametrically opposite strands. Accordingly, the outer larger strands serve to stablilize the smaller inner strands against vibration, particularly resonant vibration.

According to another important aspect of the invention, the conductive strands 12 of the cable 10 in FIG. 1 are sized and arranged to minimize the number of resonant multiples and maximize the number of damping multiples in the cable. According to the preferred practice of the invention in this regard, the cable strands 12 are sized to conform as closely as possible to the "golden ratio progression" explained earlier. In this progression, any given strand cross-section is to the next larger strand cross-section as said next larger strand cross-section is to the sum of the two strand cross-sections. Stated another way, the strand sizes corresponding to this progression are such that the ratio (i.e."golden section ratio") of any given strand cross-section to the next larger strand cross-section is about 0.62.

Associated cable strands which are sized in accordance with this golden ratio progression have different natural frequencies and periods of vibration which are irrationally or non-harmonically related, whereby such strands constitute a damping multiple which tends to suppress cable resonance. Because golden ratio progression sizing of the strands forms damping multiples, it also inherently reduces the number of resonant multiples in the cable which tend to promote or reinforce cable resonance. Accordingly, sizing the cable strands in accordance with the golden ratio progression suppresses cable resonance by the twofold action of (a) reducing the number resonant multiples in the cable, and (b) providing or increasing the number of damping multiples in the cable. Suppressing cable resonance in this way also suppresses rotational resonance in a cable with twisted strands since rotational resonance is essentially a component of the cable resonance. However, golden ratio Progression sizing of the cable strands further suppresses rotational resonance by virtue of the fact that such sizing creates an irrational or non-harmonic relation between the resonant reflections which are generated between the outermost cable points or regions (i.e. regions X in FIG. 1) by such rotational resonance, whereby these reflections tend to suppress one another and thereby the rotational resonance. While golden ratio progression sizing of the cable strands is the preferred method of reducing cable resonance, such resonance reduction may be accomplished with other cable strand sizing schedules which provide associated strands in the cable with irrationally or non-harmonically related cross-sections.

The above-described resonance suppressing multi-strand cable improvements of the invention may be embodied in cables with a wide range of cable strand numbers and layups. The cable 10 of FIG. 1, for example, has a center conductive strand 12-1 surrounded by an annular layer 20 of five larger diameter strands 12-2. Strands 12-2 are surrounded, in turn, by an annular layer 22 of ten still larger diameter strands 12-3 which are encircled by a layer of smaller fill-in strands 12-4 and the outer cable sheath 14. The fill-in strands 12-4 provide the cable with a relatively smooth circumference.

In the particular cable shown, the strands in layer 20 have the same diameter. The strands in layer 22 also have the same diameter but are larger in diameter than the strands in layer 20. The strand diameters are selected so that (a) the strands i layer are in close proximity to or contact one another circumferentially of the layer, (b) the strands in the inner layer 20 contact the center strand, and (c) the strands in the outer layer 22 contact strands in the inner layer 20. A cable with this basic strand arrangement or layup may have any number of additional layers of strands of progressively increasing cross-section, as illustrated by the cable **10*b* in FIG. 2. In each cable, except for the outer fill-in strands (12-4 in FIG. 1), the cross-sections of the strands increase progressively toward the outer cable circumference, whereby the above-discussed advantages of these cable strand arrangements are achieved. The strand arrangements of FIGS. 1 and 2** may be utilized with or without the preferred strand sizing according to which the strand cross-sections are relatively sized to conform as closely as possible to the golden ratio progression 1, 2, 3, 5, 8, 13 - - - - -.

Figure 2:
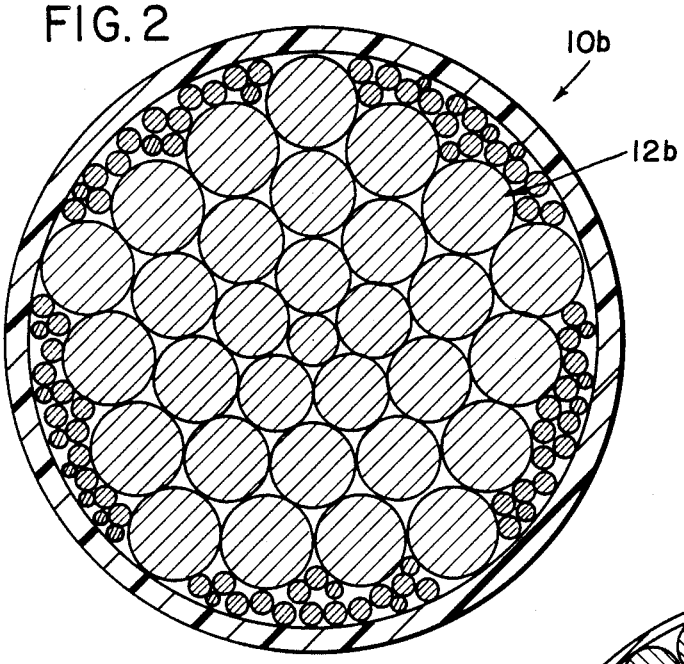
FIG. 2 is a transverse cross-section through a modified multi-strand electrical cable according to the invention similar to that of FIG. 1 but having a greater number of strands.
Figure 3:
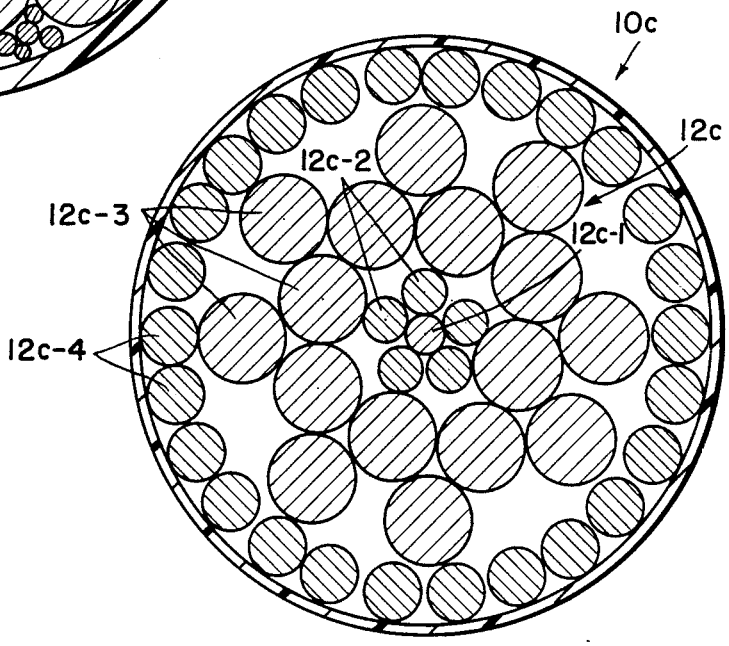
FIG. 3 is a transverse cross-section through a further modified multi-strand electrical cable according to the invention, wherein the cable strands are sized to conform precisely with the golden ratio progression.

Having all of the adjacent cable strands 12 in direct contact with one another both radially and circumferentially of the cable, as shown in FIGS. 1 and 2, may preclude sizing of the strands in precise conformance with the golden ratio progression and thereby permit only an approximation of this progression. FIG. 3 illustrates a modified cable **10*c* according to the invention whose strands 12*c* progressively increase in cross-section toward the outer cable circumference, as in FIGS. 1 and 2**, and are precisely sized in accordance with the golden ratio progression so as to attain the advantages of both this strand arrangement and sizing.

Examples of suitable wire sizes, expressed in terms of the American Wire Gauge (awg), for the conductors or wires (16 in FIGS. **1*a*, 1*b*) of the cable strands 12*c* of FIG. 3** are as follows:

| | |
|---|---|
| Strand 12c-1 | 39 awg |
| Strands 12c-2 | 37 awg |
| Strands 12c-3 | 32 awg |

The outer fill-in strands **12*c*-4** may be of any appropriate size.

Figure 4:
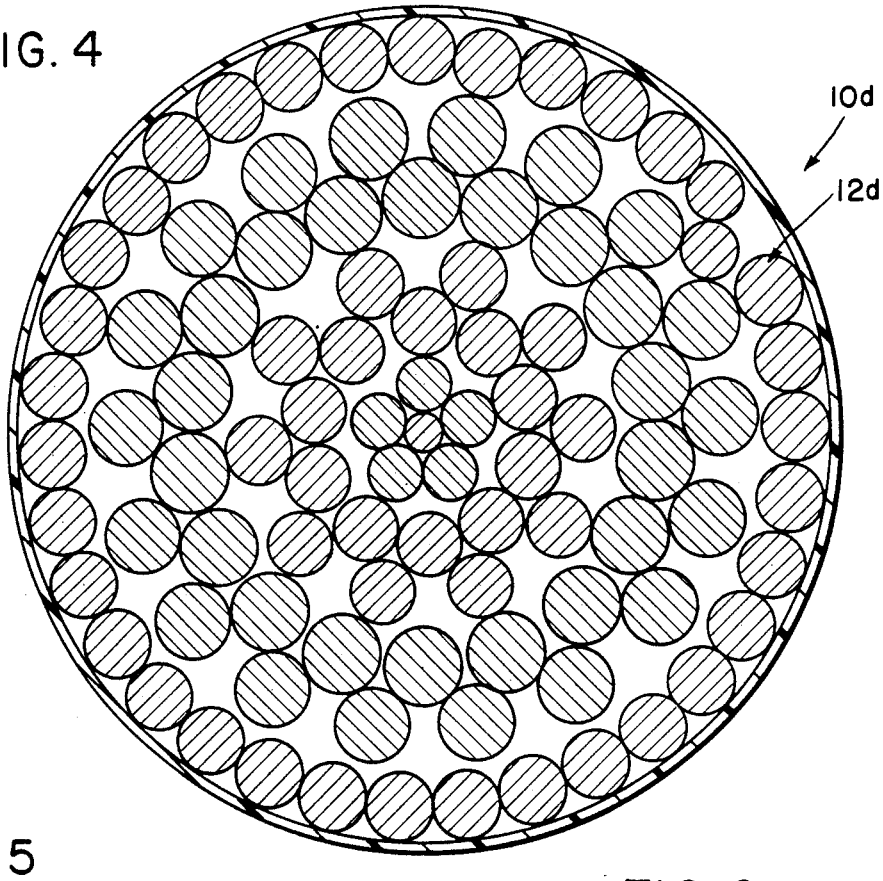
FIG. 4 is a transverse cross-section through a further modified multi-strand electrical cable according to the invention.
Figure 5:
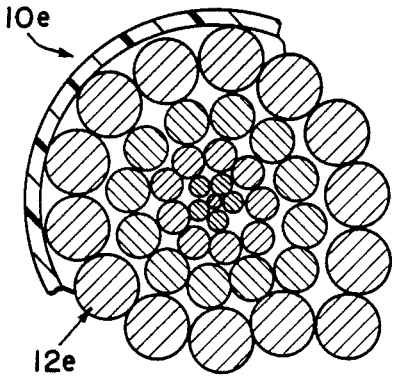
FIGS. 5 and 6 are transverse cross-sections through further modified multi-strand electrical cables according to the invention having asymmetrical cable strand layups.
Figure 6:
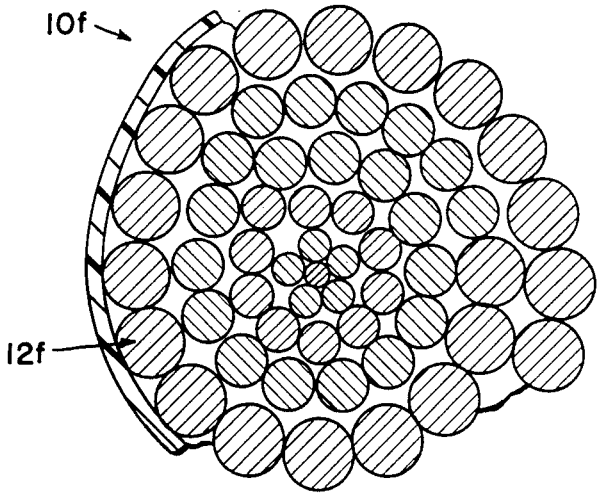

FIGS. 4-6 illustrate further cable strand arrangements or layups according to the invention. FIG. 4 shows a cable **10*d* in which the cable strands 12*d* are arranged in concentric layers and are deliberately sized so that some layers are broken, i.e. gaps are created between adjacent strands in the layers in order to further eliminate resonant multiples and resonance paths in &he cable. In the cables 10*e* and 10*f* of FIGS. 5 and 6, the cable strands 12*e* and 12*f* are progressively increased in size circumferentially about the cable to intentionally produce an asymmetric outward spiral progression of the strands starting at some point in the cable cross-section. In the particular strand arrangements or layups illustrated in FIGS. 5 and 6**, this spiral progression commences at some point beyond the first and second innermost annular strand layers. The spiral progression could commence in the innermost layer, however. Also, the progressive increase in strand size could occur either or both periodically from one group of strands to the next strand group and/or from one single strand to the next strand.

Figure 7:
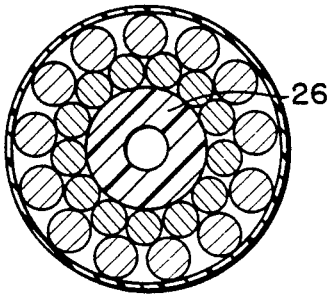
FIG. 7 is a transverse section through another form of cable of the invention wherein a central dielectric core element is utilized.

FIG. 7 illustrates another embodiment according to the invention wherein cable strands are disposed about a central axial tubular element 26 of dielectric material. The cable strands are arrayed in layers about the element 26, and the strand sizes increase in the radially outward direction, preferably in the golden section progression described earlier. Additional outward layers of strands can be utilized in addition to those shown in FIG. 7.

It will be appreciated that the strands in each of the cables of FIGS. 4–7 may be sized precisely in accordance with the golden ratio progression or some other irrational progression capable of achieving the advantages of the invention. The cable strands are preferably twisted in the same manner as the strands of conventional cables. Twisting the strands facilitates the cable fabrication, improves the strand layup, and better preserves the strand arrangement. The pitch of the strands may remain the same from one layer to the next, or the pitch may be changed in order to introduce resonance suppressing breaks or asymmetries into the cable.

Improved cables according to the invention may be used to advantage for electrical power transmission, both A.C. and D.C. power, and for high fidelity audio and data signal transmission. In all cases, corresponding ends of all cable strands will be connected to common cable terminals. With regard to electrical power transmission, the cables are particularly beneficial since they facilitate the use of aluminum conductors, which are relatively prone to fatigue stress failure, by reducing or eliminating fatigue stress in the conductors produced by resonant vibration of the cable strands.

Figure 8:
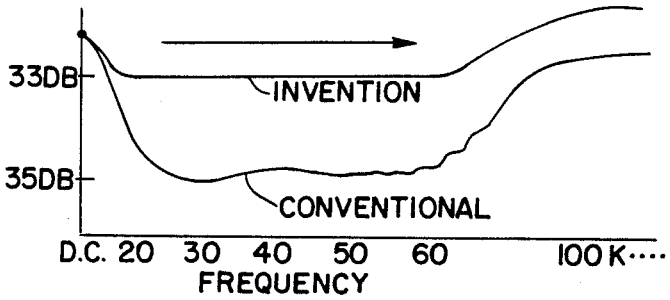
FIG. 8 is a diagram comparing transmission line losses in a conventional multi-strand electrical power transmission line cable and in an improved electrical power transmission line cable according to this invention.

As noted earlier, one advantage of the invention is reduced transmission loss in a multi-strand cable constructed in accordance with the invention compared to the loss which occurs in a conventional multi-strand cable. FIG. 8 compares the transmission losses in a conventional multi-strand cable and in a multi-strand cable of the invention.

I claim:

1. A multi-strand electrical cable comprising:

a plurality of individual electorally conductive metal strands of different cross-sections, and wherein (a) the metal of said strands is selected from the group consisting of copper and aluminum, (b) said strands are arranged so that strands of any given cross-section are located outwardly toward the cable circumference relative to strands of smaller cross-section, (c) said strands are cross-sectioned so that the ratio of any given strand cross-section to the next larger strand cross-section approximates the ratio of said next larger strand cross-section to the sum of said given cross-section and said next larger cross-section, and (d) said cable is devoid of any longitudinally extending elements other than said conductive strands and any electrical insulation about the individual strands and about the cable circumference, whereby the entire solid cross-section of the cable comprises only the conductive strands and any cable insulation.

2. A multi-strand electrical cable comprising:

a plurality of individual electrically conductive strands of different cross-sections, and wherein (a) said strands are arranged so that strands of any given cross-section are located outwardly toward the cable circumference relative to strands of smaller cross-section, and (b) said cable strands include strands arranged in a generally outward spiral progression.

3. A multi-strand electrical cable comprising:

a plurality of individual electrically conductive strands of different cross-sections twisted about the longitudinal axis of the cable and arranged so that strands of any given cross-section are located outwardly toward the cable circumference relative to strands of smaller cross-section, an insulating sheath about said strands, and wherein (a) said strands are cross-sectioned to conform closely to a golden ratio progression such that the ratio of any given strand cross-section to the next larger strand cross-section approximates the ratio of said next larger strand cross-section to the sum of said given strand cross-section and said next larger strand cross-section, and (b) certain of said cable strands are arranged in a generally outward spiral progression.

* * * * *